US006205307B1

(12) United States Patent
Nukada et al.

(10) Patent No.: US 6,205,307 B1
(45) Date of Patent: Mar. 20, 2001

(54) IMAGE-FORMING APPARATUS

(75) Inventors: Katsumi Nukada; Wataru Yamada; Kiyokazu Mashimo, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/453,512

(22) Filed: Dec. 3, 1999

(30) Foreign Application Priority Data

Jan. 25, 1999 (JP) ..... 11-016239

(51) Int. Cl.[7] ..... G03G 5/047; G03G 15/22

(52) U.S. Cl. ..... 399/152; 399/159; 399/222; 430/58.65; 430/58.7; 430/67; 430/120

(58) Field of Search ..... 430/58, 65, 58.7, 430/67, 120; 399/152, 159, 222

(56) References Cited

U.S. PATENT DOCUMENTS 5,139,912 * 8/1992 Aizawa ..... 430/67
5,352,552 * 10/1994 Maruyama ..... 430/67

FOREIGN PATENT DOCUMENTS 5-53339 3/1993 (JP) .
8-253568 10/1996 (JP) .
9-124665 5/1997 (JP) .
9-236938 9/1997 (JP) .
10-177268 6/1998 (JP) .
10-213919 8/1998 (JP) .

OTHER PUBLICATIONS

"Guiding Concepts for Developing Better Charge Transporting Organic Materials" R. Takahashi et al., Electorphotography, –the Society Journal–, vol. 29(4), 1991.

"Molecular Design for Better Charge Transporting Organic Materials (II)," H. Tanaka et al., Electrophotography –the Society Journal–, vol. 29 (4), 1990.

"Hole drift mobility and chemical structure of charge–transporting hydrazone compounds," t. Kitamura et al., J. Appl. Phys. 69, No. 1, 1990.

"Charge–transport processes in molecularly doped polymers: binder effect," H. J. Yuh et al., Philosophical magazine Letter, vol. 62, No. 1, 1990.

"Drift Mobilities in amorphous charge–transfer complexes of trinitrofluorenone and poly–n–vinylcarbazole," W. D. Gill, J. Appl. Phys., 43 (12), 1972.

Effect of polymer matrix on xerographic and hole–transport properties in molecularly doped polymers, Y. Kanemitsu et al.

* cited by examiner

*Primary Examiner*—Roland Martin
(74) *Attorney, Agent, or Firm*—Oliff & Berridge, PLC

(57) ABSTRACT

An image-forming apparatus of an electrophotographic system equipped with an electrophotographic photoreceptor, an electrostatically charger, a light-exposure, a developing device, and a transferring device, wherein the electrophotographic photoreceptor is an electrophotographic photoreceptor having at least a charge generating layer, a charge transport layer, and an uppermost surface layer successively laminated on an electrically conductive substrate, the charge transport layer having a layer containing at least 45% by weight a charge transporting material, and the wear rate of the uppermost surface layer being less than the wear rate of said layer, and the time from a light-exposure to a development is not longer than 150 m sec. The image-forming apparatus is excellent in the printing durability and the stability, gives less image flowing, and is small-sized and high-speed.

15 Claims, 1 Drawing Sheet

IMAGE-FORMING APPARATUS

FIELD OF THE INVENTION

The present invention relates to an image-forming apparatus and, specifically, to small-sized and high-speed image-forming apparatus excellent in the printing durability and stability.

BACKGROUND OF THE INVENTION

In an image-forming apparatus of an electrophotographic system, by applying an image-forming process of electrostatically charging, light-exposing, and developing to an electrophotographic photoreceptor of a rotary drum-type, etc., to form an image, and after transferring the image onto a transfer material, the image is fixed to obtained a copy and as such an image-forming apparatus, there are, for example, a plain paper copying machine (PPC), a laser printer, a light emitting diode (LED) printer, a liquid crystal printer, etc. As the electrophotographic photoreceptor used for the apparatus, an inorganic type electrophotographic photoreceptor comprising selenium, arsenic-selenium, cadmium sulfide, zinc oxide, etc., has been used. On the other hand, the investigation and development of organic type electrophotographic photoreceptor which are inexpensive and excellent in the points of the productivity and the waste disposal have been actively made and among them, a so-called function-separation type laminated electrophotographic photoreceptor having the laminate of a charge generating layer and a charge transport layer is excellent in the point of the electrophotographic characteristics such as the sensitivity, the charging property, and repeating stability, etc., and various such electrophotographic photoreceptors have been proposed and practically used.

Recently, with the increase of the performance of electrophotographic photoreceptors, high-speed copying machines and printers have been used. Furthermore, with the propagation of computers, the needs of so-called desk top publishing have been increased and small-sizing of the machine itself and small-sizing of an electrophotographic photoreceptor accompanied thereby have been strongly desired.

To obtain a stable image, it is necessary to remove the surface charge on the electrophotographic photoreceptor during the time of after light-exposing the image on the electrophotographic photoreceptor and before initiating the development. The requirement for the high speed and small-sizing is, in other words, shortening of the time required for removing the surface time, that is, the response time. If the response time is not sufficiently quick, breaking of images and thinning of fine lines occur, which becomes a large problem in a color image-forming machine requiring a particularly severe color reproducibility. The response time is dominated by the charge mobility ($\mu$) in the charge transport layer and the mobility is defined by following formula (1) from the thickness L (cm) of the charge transport layer, the voltage V (V) applied to the charge transport layer, and the time $t_T$ (second) required for a carrier reaching another surface of the charge transport layer from one surface of the transport layer:

$$\mu = L^2/V \cdot T_t \quad (1)$$

Because the charge mobility is dominated by the charge transporting material and the molecular structure of a binder resin in the transport layer, vigorous investigations have been made about these materials for increasing the charge mobility. As the results thereof, as the effective means for increasing the charge mobility, the following matters (a) to (c) have been clarified.

That is, (a) the charge transporting material has many phenyl groups capable of conjugating with a nitrogen atom, has a large extension of a conjugated system, and does no cause the deviation of the charge in the molecule (for example "Densishahsin Gakkai Shi (Journal of Electrophotographic Society)", 25(3), 16(1986); "Journal of Electrophotographic Society", 29(4), 366(1990); Journal of Applied Physics", 69, 821(1991), etc.).

(b) The binder resin does not have a polar group forming a trap of a carrier (for example, "Journal of Electrophotographic Society", 64th Investigation Forum, 75(1989); "Philosophical Magazine, Lett.", 62(1), 61(19990), etc.), etc.

(c) The concentration of the charge transporting material in the charge transport layer is increased (for example, "Journal of Applied Physics", 43(12), 5033(1972), "Journal of Electrophotographic Society", 25(3), 16(1986), etc.).

As the results of these investigations, practical materials as shown below have been investigated. That is, as the charge transporting material, a high-charge-mobility charge transporting material such as triarylamine, tetraarylbenzidine, stylbene, etc., and as the binder resin, styrene, polyphenylene oxide, polycarbonate, etc., have been developed and practically used. Also, as a means of increasing the concentration of the charge transporting material in the charge transport layer, charge transporting polycarbonate, polyester, polysilane, etc., obtained by polymerizing each charge transporting component of a charge transporting material have been vigorously investigated as the effective means. However, these charge transporting materials have been practically used for copying machines and printers but have not yet sufficient for the needs of further increasing the speed and further small-sizing.

At present, an electrophotographic photoreceptor of a so-called lamination type, that is, composed of a laminate of laminating a charge transport layer on a charge generating layer has become the mainstream and thus generally the charge transport layer becomes a surface layer. However, in a low-molecule dispersion type charge transport layer which is the mainstream at present, the charge transport layer having a sufficient performance in regard to the electric characteristics has been obtained but because a low molecular material is dispersed in a binder resin, there is a fault that the mechanical properties essential to the binder resin are lowered and the layer is essential weak in regard to abrasion. Accordingly, the amount of the charge transporting material dispersed in the binder resin is practically at most from 45 to 50% by weight. Also, when polystyrene, polyphenylene oxide, a polyphenylenevinylene derivative, etc., is used as the binder resin, the charge mobility can be increased even when the amount of the charge transporting material is same but these resins are inferior in the mechanical strength to polycarbonate and a polyester resin which have been practically used. Consequently, from various practical problems, there also occurs a limit in the response time and in the case of using for the process wherein the time from light-exposure to development is generally 150 m sec., or shorter, particularly 120 m sec., or shorter, and more particularly 100 m sec., or shorter, a problem becomes obvious. From the special demand of the circumference of an electrophotographic photoreceptor, the condition becomes remarkable when the diameter of the electrophotographic photoreceptor is not larger than 40 mm, particularly not larger than 30 mm, and more particularly not larger than 25 mm. Also, a contact charging system which has been practically used as a charging method of being reluctant to generate ozone for the consideration to an environmental problem, particularly, a contact charging system wherein the charging voltage has an alternating current component caused an abrasion acceleration of at least from 5 to 10 times as compared with a non-contact charging system such as Corotron, etc., and the problem of the durability of the electrophotographic photoreceptor becomes more remarkable. The more increase of the copying speed and more small-sizing of an electrophotographic photoreceptor means that the number of the repeated use of an electrophotographic photoreceptor per unit time is increased and in the performance of an electrophotographic photoreceptor of the present, the exchange of an electrophotographic photoreceptor becomes inevitable in a short time, which becomes a large cost up. Moreover, it is necessary to hasten the response time, as a means for increase the mobility for the purpose, it is most actual to increase the charge transporting material in the charge transport layer, but the increase of the amount of the charge transporting material is accompanied by more lowering the mechanical strength of the charge transport layer, which caused a problem in practical use.

On the other hand, a method of incorporating at least 54% triarylamine or the derivative thereof in a charge transport layer for the purposes of improving the photosensitivity and the response time is disclosed in Japanese Patent Laid-Open No. 53339/1993. However, the method aims at the prolong of the life of the charge transport layer by increasing the thickness of the layer as much as the improvement of the response time or at the prolong of the life by increasing the thickness of the charge transport layer and further forming thereon a protective layer, and does not aim at positively shortening the response time.

Also, a surface protective layer formed by dispersing an electrically conductive fine powder in an insulating resin is well known. However, this is for controlling the resistance by controlling the dispersed amount of the electrically conductive fine powder and in the above-described case, it is difficult to control the direction of flowing of electrostatic charges and essentially, image flowing is liable to occur. Because the flow of electrostatic charges has a time reliance and diffuses with the passage of time, the image flowing severely occurs when the time of from a light-exposure to a development is long. Accordingly, in the case of using the electrophotographic photoreceptor the life of which is prolonged by forming a surface layer having a high mechanical strength for an electrophotographic apparatus having a long time from a light-exposure to a development, that is, of a low-speed process, there is a problem that the image flowing is liable to occur.

Also, it is known that polysilane is a material having a high charge mobility, but because the material has a low mechanical strength, there is a problem for practical use.

SUMMARY OF THE INVENTION

The present invention has been made in view of the above-described circumstances in prior art and provides an image-forming apparatus capable of overcoming the problems as described above. That is, this invention provides a small-sized and high-speed image-forming apparatus excellent in the printing durability and the stability and giving less image flowing.

As the result of various investigations for attaining the above-described advantages in view of the problems as described above, the inventors have accomplished the present invention.

This invention is an image-forming apparatus of an electrophotographic system comprising an electrophotographic photoreceptor, an electrostatically charger, a light-exposure means, a developing device, and a transferring device, wherein said electrophotographic photoreceptor is an electrophotographic photoreceptor having at least a charge generating layer, a charge transport layer, and an uppermost surface layer successively laminated on an electrically conductive substrate, said charge transport layer having a layer containing at least 45% by weight a charge transporting material, and the wear rate of said uppermost surface layer being less than the wear rate of at least one layer of said charge transport layer, and the time from a light-exposure to a development is not longer than 150 m sec.

The layer may contains at least 50% by weight the charge transporting material.

The layer may be formed using at least one compound containing a triarylamine structure.

The compound containing a triarylamine structure may be a polymer containing the triarylamine structure as a repeating unit.

The charge mobility of the layer may be at least $1\times10^{-5}$ $cm^2/V\cdot sec.$ in an electric field strength of 30 $V/\mu m$.

The uppermost surface layer may be formed using at least one kind of a charge transporting compound containing a nitrogen atom in the structure.

The charge transporting compound containing a nitrogen atom in the structure may be a compound containing a triarylamine structure.

The uppermost surface layer may be formed using at least one kind of a crosslinking compound.

The crosslinking compound may be a charge transporting compound containing a nitrogen atom in the structure.

The uppermost surface layer may be formed using at least one kind of a compound containing at least a charge transporting component and at least one silicon atom having a hydrolyzing substituent in the same molecule.

The ratio of the wear rate of the uppermost surface layer to the wear rate of the layer (the wear rate of the uppermost surface layer/the wear rate of at least one layer of the charge transport layer) may be 0.5 or less.

The outside diameter of the electrophotographic photoreceptor may not be larger than 30 mm.

The time from the light-exposure to the development may not be longer than 120 m sec.

The electrostatically charger is a charging device of a contact-charging system.

An applying voltage of the charging device of the contact-charging system may contains an alternating electric current component.

The image-forming apparatus of this invention used an electrophotographic photoreceptor showing a quick response time and being excellent in the printing durability and the stability and is a small-sized and high-speed image-forming apparatus excellent in the printing durability and the stability and, in other words, the image-forming apparatus giving a low cost per one print.

BRIEF DESCRIPTION OF THE DRAWINGS

Preferred embodiments of an image forming apparatus according to the present invention will be described in detail based on the drawings.

DETAILED DESCRIPTION OF THE INVENTION

Figure 1:
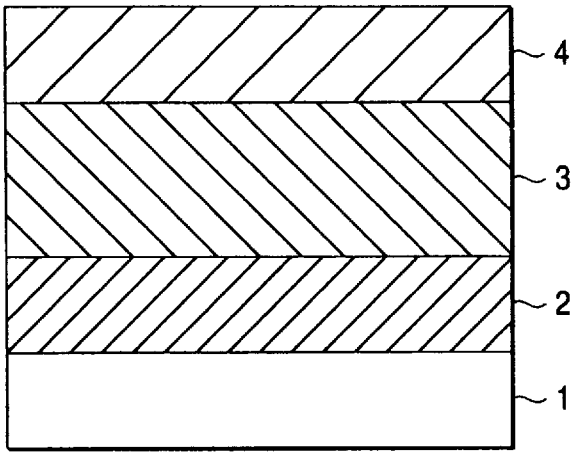
FIG. 1 is a schematic view showing a cross section of a part of an electrophotographic photoreceptor.

Then, the present invention is described in detail.

The image-forming apparatus of this invention is an image-forming apparatus of an electrophotographic system comprising an electrophotographic photoreceptor, an electrostatically charger, a light-exposure, a developing device, and a transferring device, wherein said electrophotographic photoreceptor is an electrophotographic photoreceptor having at least a charge generating layer, a charge transport layer, and an uppermost surface layer successively laminated on an electrically conductive substrate, at least one layer of said charge transport layer containing at least 45% by weight a charge transporting material, and the wear rate of said uppermost surface layer being less than the wear rate of at least one layer of said charge transport layer, and the time from a light-exposure to a development is not longer than 150 m sec.

As the described above, the electrophotographic photoreceptor used in this invention has at least a charge generating layer, a charge transport layer, and an uppermost surface layer successively laminated in an electrically conductive base (hereinafter, is referred to as a conductive support).

The above-described conductive support can be selected from optional kinds capable of being utilized as conductive supports in the field of the art and the conductive support used in this invention may be opaque or transparent. Examples of the conductive support include metal sheets, metal drums, and metal belts using a metal such as aluminum, copper, zinc, stainless steel, chromium, nickel, molybdenum, vanadium, indium, gold, platinum, etc., or the alloys thereof; electrically conductive compounds such as conductive polymers, indium oxide, etc.; and papers, plastic films, belts, etc., coated, vapor-deposited, or laminated with a metal such as aluminum, palladium, gold, etc., or the alloy thereof. Also, the form of the conductive support can be a proper form such as a drum-form, a sheet-form, a plate-from, etc.

If necessary, the conductive support can be subjected to a surface treatment in the range of giving no influences on the image quality. As the surface treatment, there are an anodic oxidizing coating treatment, a hydrothermic oxidizing treatment, a chemical treatment, a coloring treatment, and an irregular reflection treatment (e.g., sand graining, etc.), etc. Also, a layer for preventing the occurrence of an irregular reflection or controlling the injection of electrostatic charges may be formed.

Then, the charge generating layer is explained.

As the charge generating layer, any layer having a charge generating faculty can be used. Examples of the charge generating material forming the charge generating layer include various organic pigments and dyes such as condensed ring aromatic-base pigments, azo-base pigments, quinone-base pigments, perylene-base pigments, indigo-base pigments, thioindigo-base pigments, bisbenzimidazole-base pigments, phthalocyanine-base pigments, quinacridone-base pigments, oxazine-base pigments, dioxazine-base pigments, triphenylmethane-base pigments, azulenium-base dyes, squarelium-base dyes, pyrylium-base dyes, triallylmethane-base dyes, xanthene-base dyes, thiazine-base dyes, cyanine-base dyes, etc.; and inorganic materials such as amorphous silicon, amorphous selenium, tellurium, a selenium-tellurium alloy, cadmium sulfide, antimony sulfide, zinc oxide, zinc sulfide, etc. In these materials, from the points of the sensitivity, the electrical stability, and the photochemical stability to irradiating light, the condensed ring aromatic-base pigments, the perylene-base pigments, the azo-base pigments, and the phthalocyanine-base pigments are suitable. Also, these charge generating materials may be used singly or as a mixture of two or more kinds of them.

The charge generating layer can be formed by directly forming the charge generating material by a vacuum evaporation method, etc., or coating a coating liquid obtained by dissolving or dispersing the charge generating material and a binder resin in an organic solvent.

Examples of the above-described binder resin include polyvinyl butyral resins, polyvinyl formal resins, polyvinyl acetal resins (for example, a partially acetalated polyvinyl acetal resin wherein a part of butyral is modified with formal, acetoacetal, etc.), polyamide-base resins, a polyester resin, a modified ether type polyester resin, a polycarbonate resin, an acrylic resin, a polyvinyl chloride resin, a polyvinylidene chloride resin, a polystyrene resin, a polyvinyl acetate resin, a vinyl chloride-vinyl acetate copolymer, a silicone resin, a phenol resin, a phenoxy resin, a melamine resin, a benzoguanamine resin, a urea resin, a polyurethane resin, a poly-N-vinyl carbazole resin, a polyvinyl anthracene resin, a polyvinylpyrene, etc. In these binder resins, when a pigment is used as the charge generating material, the polyvinyl acetal-base resins, the vinyl chloride-vinyl acetate-base copolymers, the phenoxy resin, and the modified ether-type polyester resin are suitable because the binder resin can disperse well the pigment, the pigment is not aggregated and thus, the coating liquid can be stabilized for a long period of time, and by using the coating liquid, a uniform film can be formed to improve the electric characteristics, whereby the occurrence of the image defect can be reduced. Also, these binder resins may be used singly or as a mixture of two or more kinds thereof.

The organic solvent differs according to the kind of the material used and the optimum solvent for the material is suitably used. Examples of the organic solvent include methanol, ethanol, n-propanol, n-butanol, benzyl alcohol, methyl cellosolve, ethyl cellosolve, acetone, methyl ethyl ketone, cyclohexanone, chlorobenzene, methyl acetate, n-butyl acetate, dioxane, tetrahydrofuran, methylene chloride, and chloroform. These organic solvents may be used singly or as a mixture of two or more kinds of them.

The compounding ratio of the charge generating material to the binder resin is, as the volume ratio (charging generating material:binder resin), preferably from 10:1 to 1:3, preferably from 8:1 to 1:2 and further preferably 5:1 to 1:1.

As a method of coating a coating liquid obtained by dissolving or dispersing the charge generating material and the binder resin in the above-described organic resin, there are ordinary coating methods such as a blade coating method, a wire bar coating method, a spray coating method, a dip coating method, a bead coating method, an air knife coating method, a curtain coating method, etc.

The thickness of the charge generating layer is generally from 0.01 to 5 $\mu$m, and more preferably from 0.1 to 2.0 $\mu$m. If the thickness is thinner than 0.01 $\mu$m, the charge generating layer is hard to be uniformly formed, and if the thickness exceeds 5 $\mu$m, there is a tendency of greatly lowering the electrophotographic characteristics.

Between the above-described conductive support and the charge generating layer can be formed a subbing layer for the purposes of prevent the occurrence of the leakage of the charge from the conductive support into the charge generating layer and also adhering the charge generating layer to the conductive support to keep them in a body.

Then, the subbing layer is described.

The subbing layer can be formed using a known binder resin such as a polyamide resin, a vinyl chloride resin, a vinyl acetate resin, a phenol resin, a polyurethane resin, a melamine resin, a benzoguanamine resin, a polyimide resin, a polyethylene resin, a polypropylene resin, a polycarbonate resin, an acrylic resin, a methacrylic resin, a vinylidene chloride resin, a polyvinyl acetal resin, a vinyl chloride-vinyl acetate copolymer, a polyvinyl alcohol resin, a water-soluble polyester resin, nitrocellulose, casein, gelatin, polyglutamic acid, starch, starch acetate, amino starch, polyacrylic acid, polyacrylamide, a zirconium chelate compound, a titanyl chelate compound, a titanyl alkoxy compound, an organic titanyl compound, an alkoxysilane compound, a silane coupling agent, etc. Also, in the binder resin may be dispersed the fine particles of titanium oxide, aluminum oxide, silicon oxide, zirconium oxide, barium titanate, a silicone resin, etc. These binder resins and fine particles may be used singly or as a mixture of two or more kinds of them respectively.

The subbing layer is suitably formed by coating a coating liquid obtained by dissolving or dispersing the above-described material in a proper solvent and as the coating method, there are ordinary coating methods such as a blade coating method, a wire bar coating method, a spray coating method, a dip coating method, a bead coating method, an air knife coating method, a curtain coating method, etc.

The thickness of the subbing layer is preferably from about 0.01 to 10 $\mu$m, and more preferably from 0.05 to 2 $\mu$m.

Then, the above-described charge transport layer is described.

The charge transport layer may be composed of a single layer or plural layers but at least one layer contains at least 45% by weight, preferably at least 50% by weight, more preferably at least 55% by weight, and far more preferably at least 70% by weight a charge transporting material. If the content of the charge transporting material is less than 45% by weight, the response time is delayed and the increase of the copying speed and small-sizing of the electrophotographic photoreceptor become difficult. Also, the content of the charge transporting material is converted from the charge transporting component in the case of a high molecule compound. The charge transporting component ratio can be calculated as the ratio of the partial structure of the charge transporting component in a structural formula of the repeating unit of the high molecular compound.

The charge transport layer is suitably formed using at least one kind of a compound containing a triarylamine structure (a triphenylamine structure, a benzidine structure, etc.) as the charge transporting material from the point of the charge transporting property determining the response time. As the compound containing the triarylamine structure, a high molecular compound containing the triarylamine structure as a repeating unit is suitable from the points of the charge transporting property and the mechanical strength.

As the charge transporting material, in addition to the compound containing the triarylamine structure (a triphenylamine structure, a benzidine structure, etc.), any known materials can be used. Examples of the charge transporting material include charge transporting low-molecular compounds of pyrene-base, carbazole-base, hydrazone-base, oxazole-base, oxadiazole-base, pyrazolin-base, arylamine-base, arylmethane-base, benzidine-base, thiazole-base, stilbene-base, butadiene-base, etc.; and charge transporting high molecular compounds such as poly-N-vinylcarbazole, halogenated poly-N-vinylcarbazole, polyvinylpyrene, polyvinyl anthracene, polyvinylacrydine, a pyrene-formaldehyde resin, an ethyl carbazole-formaldehyde resin, a triphenylmethane polymer, a charge transporting polycarbonate, a charge transporting polyester, a charge transporting polysilane, etc. In these materials, the low-molecular compound containing the triarylamine structure (a triphenylamine structure, a benzidine structure, etc.) (for example, an arylamine-base charge transporting low molecular compound, etc.) and the polycarbonate, polyester or polysilane obtained by polymerizing these low molecular compounds are preferred from the point of obtaining a high charge mobility. These charge transporting materials may be used singly or as a mixture of two or more kinds of them.

The charge mobility of at least one layer of the charge transport layer is preferably at least $5\times10^{-6}$ $cm^2/V\cdot sec.$, more preferably at least $7\times10^{-6}$ $cm^2/V\cdot sec.$, and far more preferably at least $1\times10^{-5}$ $cm^2/V\cdot sec.$, at an electric field strength of 30 V/$\mu$m from the point of the response time. The charge mobility can be controlled by properly selecting the kind of the charge transporting material and the addition amount thereof.

The charge transport layer can be formed by coating a coating liquid prepared by dissolving or dispersing the above-described charge transporting material and, if desired, a binder resin in an organic solvent followed by drying.

Examples of the above-described binder resin for the charge transport layer include polycarbonate, polyester, a methacrylic resin, an acrylic resin, polyvinyl chloride, polystyrene, polyphenylene oxide, polyvinyl acetate, a styrene-butadiene copolymer, a vinylidene-acrylonitrile copolymer, a vinyl chloride-vinyl acetate copolymer, a vinyl chloride-vinyl acetate-maleic anhydride copolymer, a silicone-alkyd resin, a phenol-formaldehyde resin, a styrene-alkyd resin, poly-N-vinyl carbazole, polyvinyl butyral, polyvinyl formal, polysulfone, casein, gelatin, polyvinyl alcohol, ethyl cellulose, a phenol resin, polyamide, carboxymethyl cellulose, a vinylidene chloride-base polymer latex, polyurethane, etc. In these resins, from the point of a high charge mobility, polycarbonate, polyester, polystyrene, polyphenylene oxide, a polyphenylenevinylene derivative, a charge transporting polycarbonate, a charge transporting polyester, etc., are suitable. These binder resins may be used singly or as a mixture of two or more kinds of them.

The above-described organic solvent differs according to the material used and the optimum solvent for the material used is suitably selected. Examples of the organic solvent include methanol, ethanol, n-propanol, n-butanol, benzyl alcohol, methyl cellosolve, ethyl cellosolve, methyl ethyl ketone, cyclohexanone, chlorobenzene, methyl acetate, n-butyl acetate, dioxane, tetrahydrofuran, methylene chloride, and chloroform. These organic solvents may be used singly or as a mixture of two or more kinds thereof.

As a method of coating a coating liquid prepared by dissolving or dispersing the charge transporting material and, if desired, the binder resin in the above-described organic solvent, by dissolving or dispersing the above-described material in a proper solvent, there are ordinary coating methods such as a blade coating method, a wire bar coating method, a spray coating method, a dip coating method, a bead coating method, an air knife coating method, a curtain coating method, etc.

The thickness of the charge transport layer is preferably from about 2 to 40 $\mu$m, and more preferably from 4 to 30 $\mu$m.

Furthermore, for further shortening the response time, the thickness of the charge transport layer is far more preferably from 4 to 20 $\mu$m, and most preferably from 4 to 19 $\mu$m.

The charge transport layer may, if necessary, contain additives as antioxidants such as phenol-base compounds, sulfur-base compounds, phosphorus-base compounds, amine-base compounds, etc.; and photodeterioration preventing agents such as benzotriazole-base compounds, benzophenone-base compounds, hindered amine-base compounds, etc.

Then, the above-described uppermost surface layer is explained.

The uppermost surface layer is a layer the wear rate of which is less than the wear rate of at least one layer of the charge transport layer and by reducing the wear rate of the surface layer, the content of the charge transporting material in the charge transport layer can be increased and thus an electrophotographic photoreceptor showing a quick response time and being excellent in the printing durability and the stability can be obtained. In this invention, the term "wear rate" means the abrasion loss of the surface of the uppermost surface layer per 1000 rotations of the electrophotographic photoreceptor when each layer is the uppermost surface layer.

The ratio of the wear rate of the above-described uppermost surface layer to the wear rate of at least one layer of the charge transport layer (wear of the uppermost surface layer/wear of at least one layer of the charge transport layer) is preferably 0.5 or lower, preferably 0.3 or lower, and more preferably 0.2 or lower from the view points of the quickness of the response time, the printing durability, and the stability.

As the above-described uppermost surface layer, any layer satisfying the above-described condition of the wear rate may be used but there are, for example, a layer added with hard fine particles (e.g., Japanese Patent Laid-Open No. 282093/1994, etc.), a layer having a known charge transporting molecule dispersed in a binder resin (e.g., "Idemitus Gihoo", 36(2), 88(1993), etc.), an overcoat layer containing no charge transporting component formed on the charge transport layer (e.g., Japanese Patent Publication No. 5290/1989, etc.), a layer using a charge transporting polymer (e.g., U.S. Pat. No. 4,801,517, etc.), and a hardened charge transport layer (e.g., Japanese Patent Laid-Open No. 250423/1994, etc.), etc.

Practical examples of the uppermost surface layer include a layer containing a positive hole transporting hydroxyarylamine having a hydroxy functional group and a polyamide film-forming binder capable of forming a hydrogen bond with the hydroxy functional group (Japanese Patent Laid-Open No. 253683/1995), a film formed by adding a hydroxyarylamine compound having a hydroxy functional group and a curing catalyst to a thermosetting polyamide resin, and after coating, curing the coated film by heating (U.S. Pat. No. 5,670,291), a layer cured with a charge transporting compound having an alkoxysilyl group and an alkoxysilane compound (Japanese Patent Laid-Open No. 191358/1991), a layer cured using an organopolysiloxane, colloidal silica, an electrically conductive metal oxide, and a acrylic resin (Japanese Patent Laid-Open No. 95280/1996), a layer crosslinked with an electrically conductive metal oxide together with an acrylic acid ester having a silicon functional group (Japanese Patent Laid-Open No. 160651/1996), a layer crosslinked with an electrically conductive metal oxide together with photo-curing acrylic monomers and oligomers (Japanese Patent Laid-Open No. 184980/1996), a layer cured using a charge transporting compound containing an epoxy group (Japanese Patent Laid-Open No. 278645/1996), a layer of diamond-form carbon containing hydrogen, noncrystalline carbon, or a crystalline carbon having fluorine (Japanese Patent Laid-Open Nos. 101625/1997, 160268/1997, and 73945/1998), a layer containing cyanoethylpluran as the main constituent (Japanese Patent Laid-Open No. 90650/1997), a layer crosslinked with a silyl acrylate compound and colloidal silica (Japanese Patent Laid-Open No. 319130/1997), a layer using a polycarbonate-base graft copolymer (Japanese Patent Laid-Open No. 63026/1998), a layer formed by curing colloidal silica and a siloxane resin (Japanese Patent Laid-Open No. 83094/1998), and a layer cured with a charge transporting compound containing a hydroxyl group and an isocyanate group-containing compound (Japanese Patent Laid-Open No. 177268/1998).

As the uppermost surface layer, from the view point of the electrical stability, the layer imparted with a charge transporting property by a certain method, such as the layer formed using the charge transporting polymer, the layer formed using the charge transporting material having a reactive group, the layer having dispersed therein a conductive or semiconductive metal oxide are suitable, and from the view points of the printing durability and the life, the layer hardened by crosslinking, such as the layer formed using a crosslinking compound, etc., is suitable.

In the layer formed using the above-described charge transporting polymer, the charge transporting polymer includes a charge transporting compound containing a nitrogen atom in the structure, polysilane, a crystalline charge transporting material, etc. In these materials, from the view points of the printing durability, the mechanical strength, and the light resistance, the charge transporting material containing a nitrogen atom in the structure is suitable. Also, as the charge transporting material containing a nitrogen atom in the structure, from the view point of, particularly, the charge transporting property, the compound containing a triarylamine structure is suitable. These charge transporting polymers may be used singly or as a mixture of two or more kinds thereof.

In the layer formed using the charge transporting material having a reactive group described above, the charge transporting material having the reactive group includes a compound containing at least one charge transporting component and at least one silicon atom having a hydrolyzing substituent in the same molecule, a compound containing a charge transporting component and a hydroxyl group in the same molecule, a compound containing a charge transporting component and a carboxyl group in the same molecule, a compound containing a charge transporting component and an epoxy group in the same molecule, a compound containing a charge transporting component and an isocyanate group in the same molecule, etc. In these compounds, from the view point of the printing durability, the compound containing at least one charge transporting component and at least one silicon atom having a hydrolyzing substituent in the same molecule is suitable. These charge transporting materials each having a reactive group may be used singly or as a mixture of two or more kinds of them.

In the layer having dispersed therein the conductive or semiconductive metal oxide described above, examples of the conductive or semiconductive metal oxide include $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $In_2O_3$, ZnO, and MgO. In these metal oxides, from the view point of the image-quality stability, $SnO_2—Sb_2O_3$, $In_2O_3—SnO_2$, $TiO_2$, and $In_2O_3$ are suitable. These conductive metal oxides may be used singly or as a mixture of two or more kinds thereof.

In the layer formed using the above-described crosslinking compound, the crosslinking compound includes a crosslinking charge transporting compound having a nitrogen atom in the structure, a silicon hard coat material, a thermosetting acrylic resin, a thermosetting epoxy resin, a thermosetting urethane resin, etc. In these compounds, from the view point of the charge transporting property, the crosslinking charge transporting compound containing a nitrogen atom in the structure is suitable. These conductive metal oxides may be used singly or as a mixture of two or more kinds thereof.

The above-described uppermost surface layer may, if necessary, contain additives, for example, plasticizers such as biphenyl, biphenyl chloride, terphenyl, dibutyl phthalate, diethylene glycol phthalate, dioctyl phthalate, triphenylphosphoric acid, methyl naphthalene, benzophenone, chlorinated paraffin, polypropylene, polystyrene, various kinds of fluorohydrocarbons, etc.; surface modifying agents such as silicone oils, etc.; antioxidants such as a phenol-base compound, a sulfur-base compound, a phosphorus-base compound, an amine-base compound, etc.; and photodeterioration preventing agents such as a benzotriazole-base compound, a benzophenone-base compound, a hindered amine-base compound, etc.

The uppermost surface layer can be formed by coating a coating liquid prepared by dissolving or dispersing the material described above in an organic solvent followed by drying.

The above-described organic solvent differs according to the kind of the material used and the optimum solvent for the material may be selected. Examples of the organic solvent include alcohols such as methanol, ethanol, n-propanol, etc.; ketones such as acetone, methyl ethyl ketone, cyclohexanone, etc.; amides such as N,N-dimethylformamide, N,N-dimethylacetamide, etc.; ethers such as tetrahydrofuran, dioxane, methyl cellosolve, etc.; esters such as methyl acetate, ethyl acetate, etc.; sulfoxides and sulfones such as dimethyl sulfoxide, sulfolane, etc.; halogenated aliphatic hydrocarbons such as methylene chloride, chloroform, carbon tetrachloride, trichloroethane, etc.; aromatics such as benzene, toluene, xylene, monochlorobenzene, dichlorobenzene, etc. In these solvents, from the view point of being hard to dissolve the charge transport layer, the alcohols such as methanol, ethanol, n-propanol, etc.; the ethers such as dibutyl ether, etc.; and the hydrocarbons such as hexane, isopar, etc., are preferred.

As a method of coating a coating liquid prepared by dissolving or dispersing the above-described material(s) in the above-described organic solvent, there are ordinary coating methods such as a blade coating method, a wire bar coating method, a spray coating method, a dip coating method, a bead coating method, an air knife coating method, a curtain coating method, etc.

The thickness of the uppermost surface layer is preferably from 0.5 to 30 $\mu$m, and more preferably from 0.7 to 20 $\mu$m. If the thickness is thinner than 0.5 $\mu$m, there is a tendency of lowering the printing durability, while if the thickness exceeds 30 $\mu$m, there is a tendency of greatly lowering the electrophotographic characteristics. The thickness of the total charge transport layers added with the uppermost surface layer is preferably from about 5 to 50 $\mu$m, and more preferably from 5 to 40 $\mu$m from the view points of the image stability and the response time. Furthermore, from the view points of the sensitivity and the charging property the thickness of the total charge transport layers added with the uppermost surface layer is more preferably from 6 to 30 $\mu$m, particularly preferably from 7 to 25$\mu$m, and most preferably from 8 to 20 $\mu$m.

When in the case of forming the uppermost surface layer, there occurs that the charge transport layer as the under layer is dissolved by the organic solvent of the coating liquid of the surface layer to disturb the surface of the charge transport layer, if necessary, an interlayer may be formed between the uppermost surface layer and the charge transport layer.

As the interlayer, any layer having a resistance to the organic solvent may be used, but the layers having a low solubility, such as a polyvinyl alcohol hardened layer, a polysiloxane hardened layer, a polyurethane hardened layer, etc., are suitably used.

The thickness of the interlayer of preferably from 0.05 to 3 $\mu$m, and more preferably from 0.07 to 2 $\mu$m. If the thickness of thinner than 0.05 $\mu$m, there is a tendency that the later is inferior in the resistance to the organic solvent and if the thickness exceeds 3 $\mu$m, there is a tendency of greatly lowering the electrophotographic characteristics.

FIG. 1 is a schematic view showing cross section of a part of an embodiment of the above-described electrophotographic photoreceptor. In FIG. 1, a charge generating layer 2 is formed on a conductive support 1, a charge transport layer 3 is formed on the charge generating layer 2, and further an uppermost surface layer 4 is formed thereon.

Then, the image-forming apparatus of this invention is explained.

The image-forming apparatus of this invention is an image forming apparatus of an electrophotographic system comprising the above-described electrophotographic photoreceptor, an electrostatically charger (hereinafter, is referred to as a charger), a light-exposure means, a developing device, and a transferring device, wherein the time required from the light exposure to the development is 150 m sec. or shorter.

The outside diameter of the electrophotographic photoreceptor is preferably not larger than 30 mm, and more preferably not larger than 25 mm from the view point of obtaining the effects of the quick response time, the printing durability, and the stability.

The time required from the light-exposure to the development is 150 m sec. or shorter in this invention but, for the view point of obtaining the effects of the quick response time, the printing durability, the stability, and reducing image flowing, the time is preferably 120 m sec. or shorter, and more preferably 100 m sec. or shorter. When the time from the light exposure to the development exceeds 150 m sec., the effects of obtaining the quick response time, the printing durability, the stability, and reducing image flowing become less.

The image-forming apparatus of this invention comprises the above-described electrophotographic photoreceptor; a charger, for example, a charging roll such as Corotron, Scorotron, etc., and a charging blade; an exposure means such as a laser light system, an LED array, etc.; a developing device of forming an image using a toner, etc.; and a transferring device of transferring the toner image formed onto a medium such as a paper, etc., but may be further equipped with known means such as a fixing means of fixing the transferred toner image to a medium such as paper, etc., a static eliminating means of eliminating an electrostatic latent images remaining on the surface of the electrophotographic photoreceptor, a cleaning means such as a black, brush, a roll, etc., which is directly brought into contact with the surface of the electrophotographic photoreceptor to remove the toner, a paper powder, dust, etc., attached to the surface, etc.

As the charger, there are a charging device of a non-contact system, such as Corotron, Scorotron, etc., and a charging device of a contact system of charging the surface of the electrophotographic photoreceptor by applying an electrically conductive means in contact with the surface of the electrophotographic photoreceptor. The charging device of any system can be used in this invention but from the view points of obtaining the effects of less generation amount of ozone, giving bad influences on the environment, and being excellent in the printing durability, the charging device of a contact charging system is preferred.

In the charging device of a contact charging system described above, the form of the electrically conductive member may be a brush form, a blade form, a pin electrode form, a roller form, etc., but the roller form is particularly preferred.

The above-described roller-form member is usually composed of a resistant layer as the outside layer, an elastic layer supporting the resistant layer, and a core material and, if necessary, a protective layer can be formed on the outside of the resistant layer.

The material of the core material has an electric conductivity and is generally a resin molding having dispersed therein electrically conductive particles of a metal such as iron, copper, brass, stainless steel, aluminum, nickel, etc.

The material of the above-described elastic layer having an electric conductivity or a semiconductivity and there is generally a rubber material having dispersed therein conductive particles or semiconductive particles.

The rubber material includes EPDM, polybutadiene, a natural rubber, polyisobutyrene, SBR, CR, NBR, a silicone rubber, a urethane rubber, an epichlorohydrin rubber, SBS, a thermoplastic elastomer, a norbornene rubber, a fluorosilicone rubber, an ethylene oxide rubber, etc. The conductive particles and the semiconductive particles include carbon black; metals such as zinc, aluminum, copper, iron, nickel, chromium, titanium, etc.; and metal oxides such as ZnO—$Al_2O_3$, $SnO_2$—$Sb_2O_3$, $In_2O_3$—$SnO_2$, ZnO—$TiO_2$, MgO—$Al_2O_3$, FeO—$TiO_2$, $TiO_2$, $SnO_2$, $Sb_2O_3$, $In_2O_3$, ZnO, MgO, etc. These materials may be used singly or as a mixture of two or more kinds of them.

As the materials of the resistant layer and the protective layer described above, there are materials each formed by dispersing conductive particles or semiconductive particles in a binder resin followed by controlling the resistance. The resistivity thereof is from $10^3$ to $10^{14}$ Ωcm, preferably from $10^5$ to $10^{12}$ Ωcm, and more preferably from $10^7$ to $10^{12}$ Ωcm. Also, the thickness of the layers is from 0.01 to 1000 μm, preferably from 0.1 to 500 μm, and more preferably from 0.5 to 100 μm. Examples of the above-described binder resin include an acrylic resin, a cellulose resin, a polyamide resin, methoxymethylated nylon, ethoxyethylated nylon, a polyurethane resin, a polycarbonate resin, a polyester resin, a polyethylene resin, a polyvinyl resin, a polyacrylate resin, a polythiophene resin, a polyolefin resin (such as PFA, FEP, PET, etc.), and a styrene-butadiene resin. As the conductive particles or the semiconductive particles used in these layers, carbon black, the metals, and the metal oxides used for the elastic layer described above can be also used.

The resistant layer and the protective layer may, if necessary, contain an antioxidant such as hindered phenol, hindered amine, etc.; a filler such as clay, kaolin, etc.; and a lubricant such as a silicone oil, etc. As a means for forming the resistant layer and the protective layer, there are ordinary coating methods such as a blade coating method, a wire bar coating method, a spray coating method, a dip coating method, a bead coating method, an air knife coating method, a curtain coating method, etc.

An applying voltage to the charging device of the contact charging system described above is a DC voltage having an AC component, that is the voltage formed by piling an AC voltage on a DC voltage and particularly, from the point of effectively utilizing the printing durability of the electrophotographic photoreceptor, the voltage forming by piling an AC voltage on a DC voltage is suitable.

As the range of the above-described applying voltage, in the case of a DC voltage, according to the required charging potential of the electrophotographic photoreceptor, a positive or negative voltage of from 50 to 2000 V is preferred and the voltage of from 100 to 1500 V is more preferred. In the case of piling an AC voltage, the peak applying voltage is preferably from 400 to 1800 V, more preferably from 800 to 1600 V, and far more preferably from 1200 to 1600 V. Also, the frequency of the AC voltage is preferably from 50 to 20,000 Hz, and more preferably from 100 to 5,000 Hz.

Figure 2:
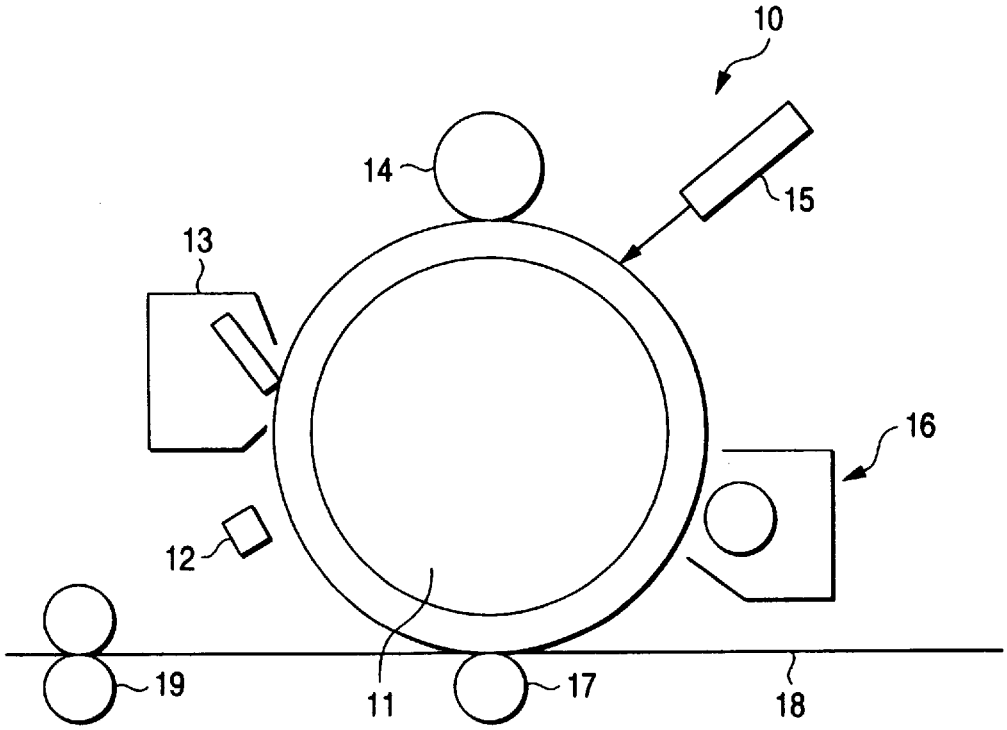
FIG. 2 is a schematic nonstructural view showing an embodiment of the electrophotographic apparatus of this invention.

FIG. 2 shows a schematic constitution of a laser printer 10 as an embodiment of the electrophotographic apparatus of this invention. The laser printer 10 is equipped with a cylindrical photoreceptor drum 11 as the electrophotographic photoreceptor of this invention and around the photoreceptor drum 11 are disposed a static eliminating light source 12 for eliminating residual electrostatic charges on the photoreceptor drum 11, a cleaning blade 13 for removing the toner remained on the photoreceptor drum 11, a charging roll 14 for charging the photoreceptor drum 11, a light-exposure laser optical system 15 for exposing the photoreceptor drum 11 based on an image signal, a developing device 16 attaching a toner onto an electrostatic latent image formed on the photoreceptor drum 11, and a transferring roll 17 for transferring a toner image on the photoreceptor drum 11 onto a transfer paper 18 in this order. Also, the laser printer 10 is equipped with a fixing roll 19 for fixing the toner image transferred onto the transfer paper 18 from the transferring roll 17.

The light exposure laser optical system 15 is equipped with a laser diode (for example, oscillation wavelength 780 nm) for irradiating a laser light based on an image signal subjected to a digital treatment, a polygon mirror polarizing the irradiated laser light, and a lens system of moving the laser light at a uniform velocity with a definite size.

Then, the present invention is explained in more detail by the following examples.

Comparative Examples 1 to 28

Preparation of Electrophotographic Photoreceptors 1 to 28

On each of aluminum pipes (outside diameters 30 mm and 20 mm) subjected to a honing treatment was coated a solution made of 10 parts (by weight) of a zirconium compound ("Organotix ZC540", trade name, manufactured by Matsumoto Seiyaku K.K.), 1 part of a silane compound ("A1110", trade name, manufactured by Nippon Unicar Company Limited), 40 parts of isopropanol, and 20 parts of butanol by a dip coating method followed by heat-drying at 150° C. for 10 minutes to form a subbing layer having a thickness of 0.1 μm.

On the subbing layer formed was coated a coating liquid obtained by mixing 1 part of chlorogallium phthalocyanine wherein the Bragg angle (2θ±0.2°) in an X-ray diffraction spectrum had strong diffraction peaks at 7.4°, 16.6°, 25.5°, and 28.3° with 1 part of polyvinyl butyral ("Srec BM-S", trade name, manufactured by Sekisui Chemical Co., Ltd.) and 100 parts of n-butyl acetate and dispersing the mixture together with glass beads by a paint shaker for one hour by a dip coating method followed by heat-drying at 100° C. for 10 minutes to form a charge generating layer having a thickness of about 0.15 μm.

Each chlorobenzene coating solution (solid component concentration: 20% by weight) containing each charge transporting material and binder resin at each composition shown in Table 1 below was prepared, coated on the charge generating layer by a dip coating method, and dried by heating to 110° C. for 40 minutes to form each charge transport layer having a thickness of 20 μm. The charge mobility of each of the charge transport layers is also shown in Table 1. Also, the structural formula of the charge transporting materials and the binder resins (CTM-1 to CTM-6, CTP-1 to CTP-2, and BP-1 to BP-3) used are shown below.

CTM-1

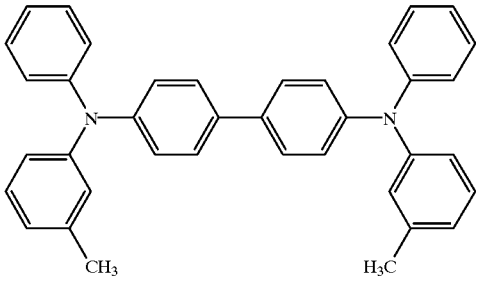

CTM-2

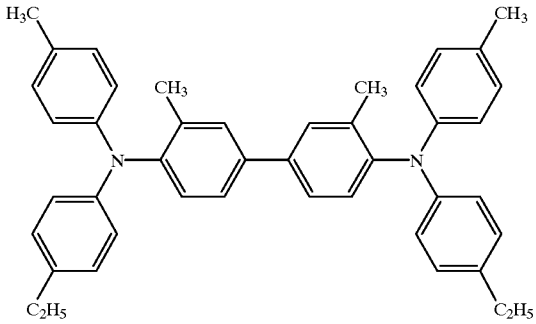

CTM-3

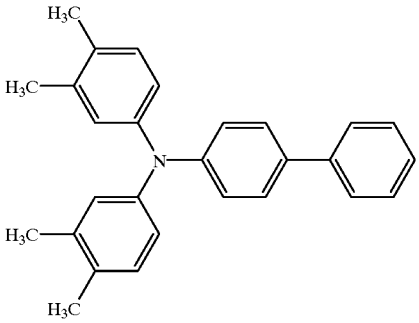

CTM-4

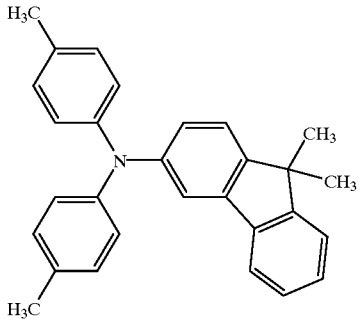

CTM-5

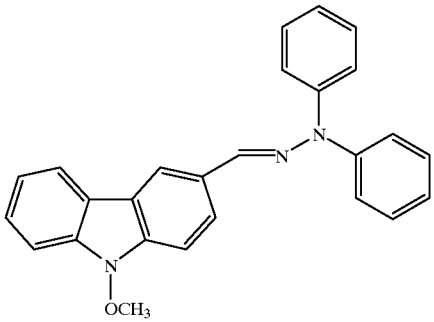

CTM-6

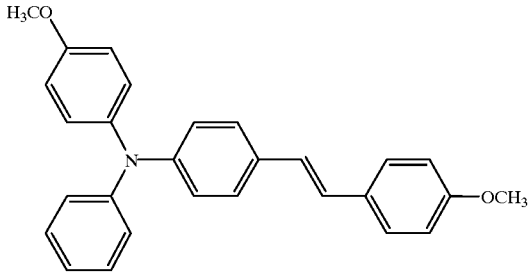

BP-1

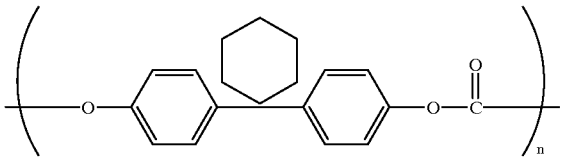

BP-2

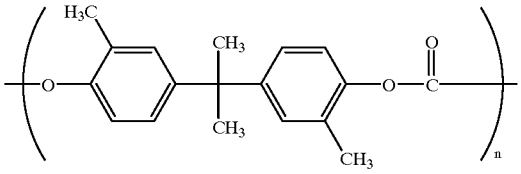

-continued

BP-3

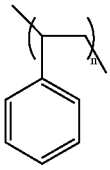

CTP-1

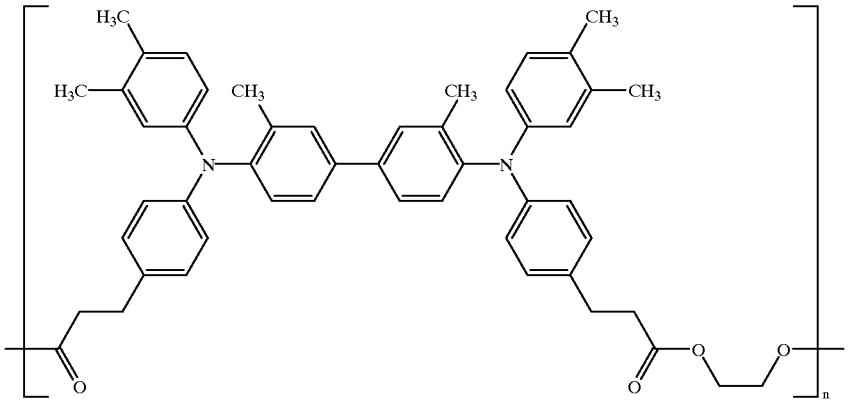

CTP-2

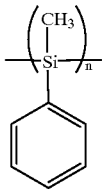

Also, the charge mobility was shown as follows. That is, a chlorobenzene coating solution of each charge transporting material was coated in an ITO glass followed by drying, a gold electrode was vapor deposited thereon, and the charge mobility was measured by an ordinary time of flight method (TOF method) and the value thereof at an electric field strength of 30 V/$\mu$m was shown.

TABLE 1

| | Charge transporting material | | Binder resin | | |
|---|---|---|---|---|---|
| | Structure | Ratio (wt. %) | Structure | Ratio (wt. %) | Charge mobility ($cm^2/V \cdot sec.$) |
| Comparative Example 1 | CTM-1 | 40 | BP-1 | 60 | $4.5 \times 10^{-6}$ |
| Comparative Example 2 | CTM-1 | 50 | BP-1 | 50 | $1.7 \times 10^{-5}$ |
| Comparative Example 3 | CTM-1 | 50 | BP-3 | 50 | $7.0 \times 10^{-5}$ |
| Comparative Example 4 | CTM-1 | 75 | BP-3 | 25 | $1.5 \times 10^{-4}$ |
| Comparative Example 5 | CTM-2 | 40 | BP-2 | 60 | $1.1 \times 10^{-5}$ |
| Comparative Example 6 | CTM-2 | 60 | BP-2 | 40 | $7.5 \times 10^{-5}$ |
| Comparative Example 7 | CTM-2 | 70 | BP-1 | 30 | $3.0 \times 10^{-4}$ |
| Comparative Example 8 | CTM-2 | 40 | BP-3 | 60 | $2.8 \times 10^{-5}$ |

TABLE 1-continued

| | Charge transporting material | | Binder resin | | |
|---|---|---|---|---|---|
| | Structure | Ratio (wt. %) | Structure | Ratio (wt. %) | Charge mobility ($cm^2/V \cdot sec.$) |
| Comparative Example 9 | CTM-2 | 70 | BP-3 | 30 | $4.9 \times 10^{-4}$ |
| Comparative Example 10 | CTM-3 | 50 | BP-1 | 50 | $1.4 \times 10^{-5}$ |
| Comparative Example 11 | CTM-3 | 70 | BP-1 | 30 | $2.5 \times 10^{-4}$ |
| Comparative Example 12 | CTM-3 | 40 | BP-3 | 60 | $8.5 \times 10^{-6}$ |
| Comparative Example 13 | CTM-3 | 70 | BP-3 | 30 | $4.5 \times 10^{-4}$ |
| Comparative Example 14 | CTM-4 | 40 | BP-1 | 60 | $6.5 \times 10^{-6}$ |
| Comparative Example 15 | CTM-4 | 70 | BP-1 | 30 | $2.2 \times 10^{-4}$ |
| Comparative Example 16 | CTM-4 | 40 | BP-3 | 60 | $8.2 \times 10^{-6}$ |
| Comparative Example 17 | CTM-4 | 70 | BP-3 | 30 | $4.1 \times 10^{-4}$ |
| Comparative Example 18 | CTM-5 | 50 | BP-1 | 50 | $3.5 \times 10^{-6}$ |
| Comparative Example 19 | CTM-5 | 70 | BP-1 | 30 | $5.6 \times 10^{-5}$ |

TABLE 1-continued

| | Charge transporting material | | Binder resin | | |
|---|---|---|---|---|---|
| | Structure | Ratio (wt. %) | Structure | Ratio (wt. %) | Charge mobility ($cm^2/V \cdot sec.$) |
| Comparative Example 20 | CTM-5 | 50 | BP-3 | 50 | $8.5 \times 10^{-6}$ |
| Comparative Example 21 | CTM-5 | 70 | BP-3 | 30 | $2.9 \times 10^{-5}$ |
| Comparative Example 22 | CTM-6 | 40 | BP-1 | 60 | $2.1 \times 10^{-5}$ |
| Comparative Example 23 | CTM-6 | 70 | BP-1 | 30 | $2.9 \times 10^{-4}$ |
| Comparative Example 24 | CTM-6 | 40 | BP-3 | 60 | $3.9 \times 10^{-5}$ |
| Comparative Example 25 | CTM-6 | 60 | BP-3 | 40 | $8.2 \times 10^{-5}$ |
| Comparative Example 26 | CTM-2 | 50 | CTP-1 | 50 | $7.5 \times 10^{-5}$ |
| Comparative Example 27 | CTM-1 | 100 | — | — | $5.5 \times 10^{-6}$ |
| Comparative Example 28 | CTM-2 | 100 | — | — | $1.0 \times 10^{-4}$ |
| Comparative Example 29 | CTM-1 | 50 | BP-1 | 50 | $1.4 \times 10^{-5}$ |
| Comparative Example 30 | CTM-3 | 50 | BP-1 | 50 | $1.1 \times 10^{-5}$ |
| Comparative Example 31 | CTM-5 | 70 | BP-3 | 30 | $2.0 \times 10^{-5}$ |

As described above, electrophotographic photoreceptors 1 to 28 having the outside diameter of 30 mm or 20 mm were prepared.

Evaluation:

Each of the electrophotographic photoreceptors 1 to 28 having the outside diameter of 30 mm or 20 mm was mounted on the image-forming apparatus of a contact charging system or a non-contact charging system shown below and the evaluation of the printing durability was carried out. In addition, the charging conditions of the electrophotographic photoreceptors are shown in Table 2 below.

Image-forming apparatus of the electrophotographic photoreceptors 1 to 28 having the outside diameter of 30 mm:

Contact charging system: A modified machine of Laser Press 4160 II manufactured by FUJI XEROX CO., LTD., which can mount an electrophotographic photoreceptor having the outside diameter of 30 mm, such that the time from the light exposure to the development become variable (200 m sec. and 150 m sec.). The modified machine of Laser Press 4160 II has a charging roll for contact charging, a laser exposure optical system, a toner developing device, a transferring roll, a cleaning blade, and a fixing roll.

Non-contact charging system: A modified machine of Laser Press 4160 II manufactured by FUJI XEROX CO. , LTD., which can mount an electrophotographic photoreceptor having the outside diameter of 30 mm, such that the time from the light exposure to the development become variable (200 m sec. and 150 m sec.). The modified machine of Laser Press 4160 II has Scorotron for non-contact charging, a laser exposure optical system, a toner developing device, a transferring roll, a cleaning blade, and a fixing roll.

Image-forming apparatus of the electrophotographic photoreceptors having the outside diameter of 20 mm:

Contact charging system: Evaluation machine manufactured by FUJI XEROX CO., LTD. for in company use, which can mount an electrophotographic photoreceptor having the inside diameter of 20 mm, which is designed such that the time from the light-exposure to the development is variable (120 m sec. and 100 m sec.). The evaluation machine has a charging roll for contact charging, a laser exposure optical system, a toner developing device, a transferring roll, a cleaning blade, and a fixing roll.

Non-contact charging system: Evaluation machine manufactured by FUJI XEROX CO., LTD. for in company use, which can mount an electrophotographic photoreceptor having the inside diameter of 20 mm, which is designed such that the time from the light-exposure to the development is variable (120 m sec. and 100 m sec.). The evaluation machine has Scorotron for non-contact charging, a laser exposure optical system, a toner developing device, a transferring roll, a cleaning blade, and a fixing roll.

TABLE 2

| Charging system | Contact charging system | | | |
|---|---|---|---|---|
| Diameter of electrophotographic photoreceptor | 30 mm | | 20 mm | |
| Time from exposure to development | 200 msec | 150 msec | 120 msec | 100 mmsec |
| AC current<br>DC voltage | 1.2 mA<br>−450 V | 1.8 mA<br>−450 V | 1.3 mA<br>−450 V | 1.8 mA<br>−450 V |
| **Charging system** | **Non-contact system** | | | |
| Diameter of electrophotographic photoreceptor | 30 mm | | 20 mm | |
| Time from exposure to development | 200 msec | 150 msec | 120 msec | 100 mmsec |
| Applied electric current<br>Applied voltage | −300 μA<br>4.5 KV | −450 μA<br>5.0 KV | −320 μA<br>4.5 KV | −450 μA<br>5.0 KV |

Evaluation method of printing durability:

The evaluation of the printing durability was carried out as the image quality evaluation before and after printing 50,000 copies and the evaluation of the reduced amount of the thickness of the electrophotographic photoreceptor by abrasion (wear rate). The results are shown in Tables 3 and 4.

For the image quality evaporation, a standard test pattern for in-company use was used, the reproducibility of particularly fine lines was evaluated, and the evaluation was carried out by following 7 grades.

G-1: Good

G-2: Fine line becomes thinner a little.

G-3: The fine line is broken a little.

G-4: The fine line is frequently broken.

G-5: Whole image is largely blurred.

F: Image flowing occurs a little.

x: Image becomes unobtainable before copying 50,000 copies by the abrasion of charge transport layer.

As the reduced amount of the thickness (wear rate), the abrasion loss per 1000 rotation of the electrophotographic photoreceptor was employed such that it could be compared by ignoring the influence of the diameter of the electrophotographic photoreceptor. In addition, as papers for continuous printing, acidic papers were used and the copying test was carried out in the environment of normal temperature and normal pressure (about 20° C., 50% RH). The reduced amount of the thickness (wear rate) is shown by the average value of the measurement results of the reduced amounts of thickness (wear rates) in the two charging systems.

TABLE 3

| | *1 Contact charging system | | | | |
|---|---|---|---|---|---|
| | *2 | | | | |
| | 30 mm | | 20 mm | | |
| | *3 | | | | |
| | 200 msec Image quality | 150 msec Image quality | 120 msec Image quality | 100 msec Image quality | Average value of wear rates |
| Comparative Example 1 | G-1 | G-1 | x | x | 90 |
| Comparative Example 2 | x | x | x | x | 120 |
| Comparative Example 3 | x | x | x | x | 550 |
| Comparative Example 4 | x | x | x | x | 900 |
| Comparative Example 5 | G-1 | G-1 | x | x | 85 |
| Comparative Example 6 | x | x | x | x | 160 |
| Comparative Example 7 | x | x | x | x | 320 |
| Comparative Example 8 | x | x | x | x | 610 |
| Comparative Example 9 | x | x | x | x | 1100 |
| Comparative Example 10 | x | x | x | x | 115 |
| Comparative Example 11 | x | x | x | x | 305 |
| Comparative Example 12 | x | x | x | x | 600 |
| Comparative Example 13 | x | x | x | x | 1200 |
| Comparative Example 14 | G-1 | G-1 | x | x | 95 |
| Comparative Example 15 | x | x | x | x | 320 |

TABLE 3-continued

| | *1 Non-contact charging system | | | | |
|---|---|---|---|---|---|
| | *2 | | | | |
| | 30 mm | | 20 mm | | |
| | *3 | | | | |
| | 200 msec Image quality | 150 msec Image quality | 120 msec Image quality | 100 msec Image quality | Average value of wear rates |
| Comparative Example 1 | G-1 | G-1 | G-2 | G-4 | 15 |
| Comparative Example 2 | G-1 | G-1 | G-1 | G-2 | 21 |
| Comparative Example 3 | x | x | x | x | 105 |
| Comparative Example 4 | x | x | x | x | 200 |
| Comparative Example 5 | G-1 | G-1 | G-1 | G-2 | 14 |
| Comparative Example 6 | G-1 | G-1 | G-1 | G-1 | 25 |
| Comparative Example 7 | G-1 | G-1 | G-1 | G-1 | 55 |
| Comparative Example 8 | x | x | x | x | 110 |
| Comparative Example 9 | x | x | x | x | 200 |
| Comparative Example 10 | G-1 | G-1 | G-1 | G-2 | 23 |
| Comparative Example 11 | G-1 | G-1 | G-1 | G-1 | 57 |
| Comparative Example 12 | G-1 | G-1 | G-2 | G-3 | 95 |
| Comparative Example 13 | x | x | x | x | 180 |
| Comparative Example 14 | G-1 | G-1 | G-2 | G-3 | 17 |
| Comparative Example 15 | G-1 | G-1 | G-1 | G-1 | 60 |

*1: Charging system
*2: Diameter of electrophotographic photoreceptor
*3: Time from exposure to development
Unit of wear rate (nm/1000 rotation of the electrophotographic photoreceptor)

TABLE 4

| | *1 Contact charging system | | | | |
|---|---|---|---|---|---|
| | *2 | | | | |
| | 30 mm | | 20 mm | | |
| | *3 | | | | |
| | 200 msec Image quality | 150 msec Image quality | 120 msec Image quality | 100 msec Image quality | Average value of wear rates |
| Comparative Example 16 | x | x | x | x | 550 |
| Comparative Example 17 | x | x | x | x | 1000 |
| Comparative Example 18 | x | x | x | x | 135 |
| Comparative Example 19 | x | x | x | x | 310 |
| Comparative Example 20 | x | x | x | x | 520 |
| Comparative Example 21 | x | x | x | x | 600 |

TABLE 4-continued

| | | | | | |
|---|---|---|---|---|---|
| Comparative example 22 | G-1 | G-1 | x | x | 90 |
| Comparative Example 23 | x | x | x | x | 350 |
| Comparative Example 24 | x | x | x | x | 480 |
| Comparative Example 25 | x | x | x | x | 1250 |
| Comparative Example 26 | x | x | x | x | 110 |
| Comparative Example 27 | G-1 | G-1 | G-1 | G-2 | 55 |
| Comparative Example 28 | x | x | x | x | 1350 |
| Comparative Example 29 | x | x | x | x | 130 |
| Comparative Example 30 | x | x | x | x | 120 |
| Comparative Example 31 | x | x | x | x | 650 |

| | *1 Non-contact charging system | | | | |
|---|---|---|---|---|---|
| | *2 | | | | |
| | 30 mm | | 20 mm | | |
| | *3 | | | | |
| | 200 msec Image quality | 150 msec Image quality | 120 msec Image quality | 100 msec Image quality | Average value of wear rates |
| Comparative Example 16 | x | x | x | x | 100 |
| Comparative Example 17 | x | x | x | x | 170 |
| Comparative Example 18 | G-1 | G-2 | G-3 | G-4 | 25 |
| Comparative Example 19 | G-1 | G-1 | G-1 | G-2 | 55 |
| Comparative Example 20 | x | x | x | x | 105 |
| Comparative Example 21 | x | x | x | x | 190 |
| Comparative Example 22 | G-1 | G-1 | G-1 | G-2 | 16 |
| Comparative Example 23 | G-1 | G-1 | G-1 | G-1 | 58 |
| Comparative Example 24 | G-1 | G-1 | G-1 | G-2 | 95 |
| Comparative Example 25 | x | x | x | x | 200 |
| Comparative Example 26 | G-1 | G-1 | G-1 | G-2 | 21 |
| Comparative Example 27 | G-1 | G-1 | G-1 | G-2 | 10 |
| Comparative Example 28 | x | x | x | x | 200 |
| Comparative Example 29 | G-1 | G-1 | G-1 | G-2 | 22 |
| Comparative Example 30 | G-1 | G-1 | G-1 | G-2 | 25 |
| Comparative Example 31 | x | x | x | x | 195 |

*1: Charging system
*2: Diameter of electrophotographic photoreceptor
*3 Time from exposure to development
Unit of wear rate (nm/1000 rotation of the electrophotographic photoreceptor)

Comparative Examples 29 to 31

By following the same procedures as Comparative Examples 2, 10, and 21 except that in the formation of the charge transport layers of Comparative Examples 2, 10, and 21, 2,6-di-t-butylhydroxytoluene was added to each chlorobenzene coating liquid of the charge transporting material, electrophotographic photoreceptors 29 to 31 having the outside diameter of 30 mm or 20 mm were prepared and the evaluations as above were carried out. In addition, the compositions of the charge transport layers of Comparative Examples 29 to 31 and the charge mobilities of the charge transport layers of these comparative examples are shown in Table 1 above.

In Comparative Examples 1 to 31, in the case of image formation by a contact charging system, when the case that the time of the light exposure to the development was 150 m sec. is compared with the case that the time was 200 m sec., in the case that the time was 150 m sec., about 60% of printed images could not be obtained and the wear rate was about 1.5 times larger.

Examples 1 to 24

By following the same procedures as the above-described comparative examples except that the uppermost surface layer shown below was formed on each electrophotographic photoreceptor (hereinafter, is sometimes referred to as a base photoreceptor) having the outside diameter of 30 mm or 20 mm, the electrophotographic photoreceptors of Examples 1 to 24 were prepared and evaluated. Each combination of the base photoreceptor and the uppermost surface layer is shown in Table 5 and the evaluation results are shown in Tables 6 and 7. Also, the ratio of the base photoreceptor to the wear rate is shown in Table 5. The ratio of the wear rate was calculated by using the mean value of the measurement values of the reduced amounts of the thicknesses (wear rates) in the charging systems.

Examples 25 to 32

By following the same procedures as the above-described comparative examples except that the uppermost surface layer shown below was formed on each base photoreceptor, wherein the the thickness of the charge transport layer was 13 $\mu$m, the electrophotographic photoreceptors of Examples 25 to 32 were prepared and evaluated. Each combination of the base photoreceptor and the uppermost surface layer is shown in Table 5 and the evaluation results are shown in Tables 6 and 7. Also, the ratio of the base photoreceptor to the wear rate is shown in Table 5. The ratio of the wear rate was calculated by using the mean value of the measurement values of the reduced amounts of the thicknesses (wear rates) in the charging systems.

TABLE 5

| | | | Ratio of base photoreceptor to wear rate | |
|---|---|---|---|---|
| | Base photoreceptor | Uppermost surface layer | Contact charging system | Non-contact charging system |
| Example 1 | Photoreceptor 2 | Uppermost surface layer 1 | 0.19 | 0.24 |
| Example 2 | Photoreceptor 4 | Uppermost surface layer 1 | 0.03 | 0.03 |
| Example 3 | Photoreceptor 4 | Uppermost surface layer 2 | 0.02 | 0.02 |
| Example 4 | Photoreceptor 4 | Uppermost surface layer 3 | 0.01 | 0.01 |
| Example 5 | Photoreceptor 2 | Uppermost surface layer 4 | 0.46 | 0.48 |
| Example 6 | Photoreceptor 4 | Uppermost surface layer 5 | 0.01 | 0.01 |

TABLE 5-continued

| | Base photoreceptor | Uppermost surface layer | Ratio of base photoreceptor to wear rate: Contact charging system | Ratio of base photoreceptor to wear rate: Non-contact charging system |
|---|---|---|---|---|
| Example 7 | Photoreceptor 6 | Uppermost surface layer 2 | 0.14 | 0.12 |
| Example 8 | Photoreceptor 7 | Uppermost surface layer 3 | 0.04 | 0.02 |
| Example 9 | Photoreceptor 7 | Uppermost surface layer 5 | 0.04 | 0.02 |
| Example 10 | Photoreceptor 9 | Uppermost surface layer 3 | 0.01 | 0.01 |
| Example 11 | Photoreceptor 9 | Uppermost surface layer 5 | 0.01 | 0.01 |
| Example 12 | Photoreceptor 10 | Uppermost surface layer 1 | 0.2 | 0.22 |
| Example 13 | Photoreceptor 11 | Uppermost surface layer 1 | 0.08 | 0.09 |
| Example 14 | Photoreceptor 13 | Uppermost surface layer 3 | 0.02 | 0.02 |
| Example 15 | Photoreceptor 15 | Uppermost surface layer 2 | 0.07 | 0.05 |
| Example 16 | Photoreceptor 17 | Uppermost surface layer 5 | 0.02 | 0.01 |
| Example 17 | Photoreceptor 18 | Uppermost surface layer 4 | 0.41 | 0.4 |
| Example 18 | Photoreceptor 19 | Uppermost surface layer 3 | 0.07 | 0.05 |
| Example 19 | Photoreceptor 23 | Uppermost surface layer 3 | 0.06 | 0.05 |
| Example 20 | Photoreceptor 25 | Uppermost surface layer 3 | 0.02 | 0.02 |
| Example 21 | Photoreceptor 26 | Uppermost surface layer 1 | 0.21 | 0.24 |
| Example 22 | Photoreceptor 27 | Uppermost surface layer 1 | 0.42 | 0.5 |
| Example 23 | Photoreceptor 2 | Uppermost surface layer 1 | 0.19 | 0.24 |
| Example 24 | Photoreceptor 2 | Uppermost surface layer 4 | 0.46 | 0.48 |
| Example 25 | Photoreceptor 10 | Uppermost surface layer 1 | 0.2 | 0.22 |
| Example 26 | Photoreceptor 18 | Uppermost surface layer 4 | 0.41 | 0.4 |
| Example 27 | Photoreceptor 19 | Uppermost surface layer 3 | 0.07 | 0.05 |
| Example 28 | Photoreceptor 26 | Uppermost surface layer 1 | 0.21 | 0.24 |
| Example 29 | Photoreceptor 27 | Uppermost surface layer 1 | 0.42 | 0.5 |
| Example 30 | Photoreceptor 28 | Uppermost surface layer 3 | 0.17 | 0.14 |
| Example 31 | Photoreceptor 29 | Uppermost surface layer 3 | 0.18 | 0.12 |
| Example 32 | Photoreceptor 31 | Uppermost surface layer 3 | 0.03 | 0.02 |

TABLE 6

| | *1 Contact charging system | | | | |
|---|---|---|---|---|---|
| | *2 | | | | |
| | 30 mm | | 20 mm | | |
| | *3 | | | | |
| | 200 msec Image quality | 150 msec Image quality | 120 msec Image quality | 100 msec Image quality | Average value of wear rates |
| Example 1 | G-1 | G-1 | G-1 | G-2 | 23 |
| Example 2 | G-1 | G-1 | G-1 | G-1 | 23 |

TABLE 6-continued

| | | | | | |
|---|---|---|---|---|---|
| Example 3 | G-1 | G-1 | G-1 | G-1 | 22 |
| Example 4 | F | G-1 | G-1 | G-1 | 12 |
| Example 5 | G-1 | G-1 | G-1 | G-2 | 55 |
| Example 6 | F | G-1 | G-1 | G-1 | 13 |
| Example 7 | G-1 | G-1 | G-1 | G-1 | 22 |
| Example 8 | F | G-1 | G-1 | G-1 | 12 |
| Example 9 | F | G-1 | G-1 | G-1 | 13 |
| Example 10 | F | G-1 | G-1 | G-1 | 12 |
| Example 11 | F | G-1 | G-1 | G-1 | 13 |
| Example 12 | G-1 | G-1 | G-1 | G-2 | 23 |
| Example 13 | G-1 | G-1 | G-1 | G-1 | 23 |
| Example 14 | F | G-1 | G-1 | G-1 | 22 |
| Example 15 | G-1 | G-1 | G-1 | G-1 | 22 |

| | *1 Non-contact charging system | | | | |
|---|---|---|---|---|---|
| | *2 | | | | |
| | 30 mm | | 20 mm | | |
| | *3 | | | | |
| | 200 msec Image quality | 150 msec Image quality | 120 msec Image quality | 100 msec Image quality | Average value of wear rates |
| Example 1 | G-1 | G-1 | G-1 | G-2 | 5 |
| Example 2 | G-1 | G-1 | G-1 | G-1 | 5 |
| Example 3 | G-1 | G-1 | G-1 | G-1 | 3 |
| Example 4 | F | G-1 | G-1 | G-1 | 1 |
| Example 5 | G-1 | G-1 | G-1 | G-2 | 10 |
| Example 6 | F | G-1 | G-1 | G-1 | 1 |
| Example 7 | G-1 | G-1 | G-1 | G-1 | 3 |
| Example 8 | F | G-1 | G-1 | G-1 | 1 |
| Example 9 | F | G-1 | G-1 | G-1 | 1 |
| Example 10 | F | G-1 | G-1 | G-1 | 1 |
| Example 11 | F | G-1 | G-1 | G-1 | 1 |
| Example 12 | G-1 | G-1 | G-1 | G-2 | 5 |
| Example 13 | G-1 | G-1 | G-1 | G-1 | 5 |
| Example 14 | F | G-1 | G-1 | G-1 | 3 |
| Example 15 | G-1 | G-1 | G-1 | G-1 | 3 |

*1: Charging system
*2: Diameter of electrophotographic photoreceptor
*3: Time from light-exposure to development
Unit of wear ratio: (nm/1000 rotation of the electrophotographic photoreceptor)

TABLE 7

| | *1 Contact charging system | | | | |
|---|---|---|---|---|---|
| | *2 | | | | |
| | 30 mm | | 20 mm | | |
| | *3 | | | | |
| | 200 msec Image quality | 150 msec Image quality | 120 msec Image quality | 100 msec Image quality | Average value of wear rates |
| Example 16 | F | G-1 | G-1 | G-1 | 13 |
| Example 17 | G-1 | G-2 | G-3 | G-4 | 55 |
| Example 18 | F | G-1 | G-1 | G-2 | 22 |
| Example 19 | F | G-1 | G-1 | G-1 | 22 |
| Example 20 | F | G-1 | G-1 | G-1 | 22 |
| Example 21 | G-1 | G-1 | G-1 | G-2 | 23 |
| Example 22 | G-1 | G-1 | G-1 | G-2 | 23 |
| Example 23 | G-1 | G-1 | G-1 | G-1 | 23 |
| Example 24 | G-1 | G-1 | G-1 | G-1 | 55 |
| Example 25 | G-1 | G-1 | G-1 | G-1 | 23 |
| Example 26 | G-1 | G-1 | G-1 | G-2 | 55 |
| Example 27 | F | G-1 | G-1 | G-1 | 22 |
| Example 28 | G-1 | G-1 | G-1 | G-1 | 23 |
| Example 29 | G-1 | G-1 | G-1 | G-1 | 23 |

TABLE 7-continued

| | | | | | |
|---|---|---|---|---|---|
| Example 30 | F | G-1 | G-1 | G-1 | 22 |
| Example 31 | F | G-1 | G-1 | G-1 | 22 |
| Example 32 | F | G-1 | G-1 | G-1 | 22 |
| | *1 Non-contact charging system | | | | |
| | *2 | | | | |
| | 30 mm | | 20 mm | | |
| | *3 | | | | |
| | 200 msec Image quality | 150 msec Image quality | 120 msec Image quality | 100 msec Image quality | Average value of wear rates |
| Example 16 | F | G-1 | G-1 | G-1 | 1 |
| Example 17 | G-1 | G-2 | G-3 | G-4 | 10 |
| Example 18 | F | G-1 | G-1 | G-2 | 3 |
| Example 19 | F | G-1 | G-1 | G-1 | 3 |
| Example 20 | F | G-1 | G-1 | G-1 | 3 |
| Example 21 | G-1 | G-1 | G-1 | G-2 | 5 |
| Example 22 | G-1 | G-1 | G-1 | G-2 | 5 |
| Example 23 | G-1 | G-1 | G-1 | G-1 | 5 |
| Example 24 | G-1 | G-1 | G-1 | G-1 | 10 |
| Example 25 | G-1 | G-1 | G-1 | G-1 | 5 |
| Example 26 | G-1 | G-1 | G-1 | G-2 | 10 |
| Example 27 | F | G-1 | G-1 | G-1 | 3 |
| Example 28 | G-1 | G-1 | G-1 | G-1 | 5 |
| Example 29 | G-1 | G-1 | G-1 | G-1 | 5 |
| Example 30 | F | G-1 | G-1 | G-1 | 3 |
| Example 31 | F | G-1 | G-1 | G-1 | 3 |
| Example 32 | F | G-1 | G-1 | G-1 | 3 |

*1: Charging system
*2: Diameter of electrophotographic photoreceptor
*3: Time from light-exposure to development
Unit of wear ratio: (nm/1000 rotation of the electrophotographic photoreceptor)

Uppermost surface layer 1:

A solution obtained by dissolving 1 part of compound (1) having the following structural formula and 2 parts of a solution (solid component 67% by weight) of a burette modified product shown by following compound (2) in 50 parts of cyclohexane was spray-coated on the charge transport layer and after drying at normal temperature for 10 minutes, the coated layer formed was dried to 150° C. for 60 minutes to form a layer having a thickness of 4 μm, which was defined as uppermost surface layer 1.

(1)

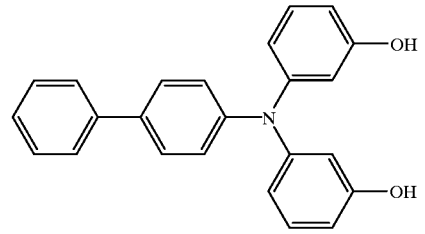

(2)

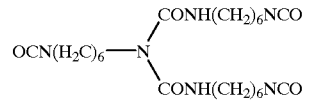

Uppermost surface layer 2:

A coating solution obtained by mixing 10 parts of compound (3) having the following structural formula, 20 parts of a hardening siloxane resin ("X-40-2239", trade name, manufactured by Shin-Etsu Silicone K.K.), 3 parts of phenyl triethoxysilane, a fluorine-containing silane coupling agent ("KBM-7803", trade name, manufactured by Shin-Etsu Silicone K.K.), and 1 part of acetic acid was spray-coated on the charge transport layer and after drying at normal temperature for 30 minutes, the coated layer was heat-treated at 120° C. for 60 minutes to form a layer having a thickness of 5 μm., which was defined as Uppermost surface layer 2.

(3)

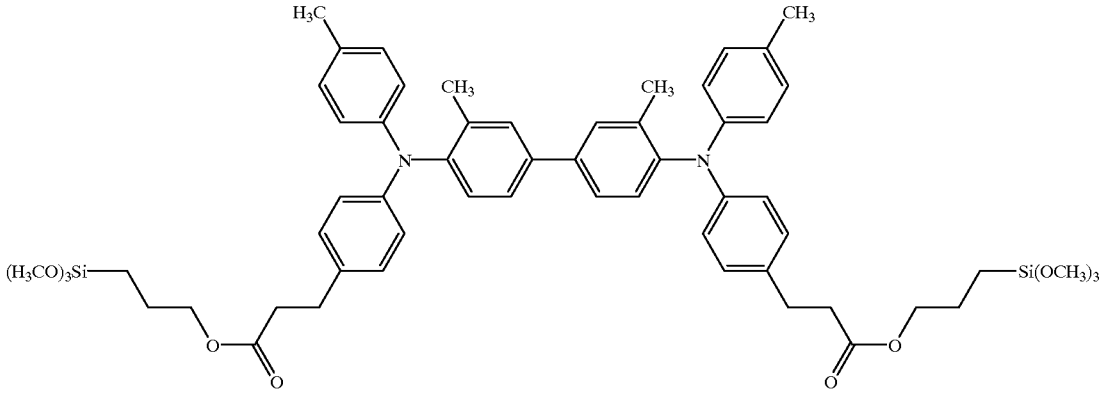

Uppermost surface layer 3:

To the coating solution for Uppermost surface layer 2 described above was further added 5 parts of tetraethoxysilane and the coating liquid obtained was spray-coated on the charge transport layer and after drying at normal temperature, the coated layer was heat-treated at 120° C. for 60 minutes to form a layer having a thickness of 5 μm, which was defined to be Uppermost surface layer 3.

Uppermost surface layer 4:

A solution obtained by dissolving 1 part of a hardening siloxane resin ("X-40-2239", trade name, manufactured by Shin-Etsu Silicone K.K.) was spray-coated on the charge transport layer and after drying at normal temperature for 10 minutes, the coated layer was heated to 150° C. for 20 minutes to form a dissolution-preventing layer (interlayer) having a thickness of 0.05 μm. Furthermore, a solution obtained by dissolving 5 parts of CTP-1 in 30 parts of toluene was dip-coated on the layer to form a layer having a thickness of 5 μm, which was defined to be uppermost surface layer 4.

Uppermost surface layer 5:

A dispersed solution obtained by heat-treating a mixture of 100 parts of antimony-containing tin oxide fine particles having a mean particle size of 0.02 μm ("T-1", trade name, made by MITSUBISHI MATERIAL CORPORATION), 30 parts of 3-aminopropyltrimethoxysilane and 300 parts of ethanol by a milling apparatus for one hour was filtrated, the fine particles collected were washed with ethanol, dried, and heat-treated at 120° C. for one hour to carry out the surface treatment the fine particles. Then, a mixture of 30 parts of the acryl monomer having following structural formula (4), 0.5 part of 2-methyl thioxanthone as a photopolymerization agent, 35 parts of the antimony-containing tin oxide fine particles subjected to the surface treatment as described above, and 300 parts of toluene was dispersed by a sand mill apparatus for 100 hours to form a dispersion. The dispersion was mixed with 25 parts of ethylene tetrafluoride resin particles ("Rublon L-2", trade name, manufactured by DAIKIN INDUSTRIES, LTD.) and by dispersing the mixture by a sand mill apparatus for 8 hours, a dispersion was prepared. The dispersion was spray-coated on the charge transport layer and after drying, the coated layer was irradiated by ultraviolet rays using a high-pressure mercury lamp at a light intensity of 600 mW/cm$^2$, a layer having a thickness of 4 μm was formed. The layer was defined to be uppermost surface layer 5.

(4)

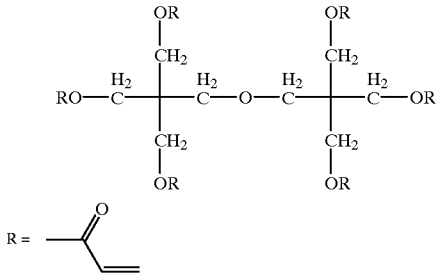

In Examples 1 to 32, when in the image formation of a contact charging system, the case that the time from the light exposure to development was 150 m sec. was compared with that case that the time was 200 m sec., much images cause image flowing in the case that the time was 200 m sec., as compared with the case that the time was 150 m sec.

Examples 33 to 35

By following the same procedure as Comparative Example 1 except that the thickness of the charge transport layer of the electrophotographic photoreceptor 18 having the outside diameter of 30 mm (Comparative Example 18) was changed to 30 μm, 25 μm, or 15 μm respectively, the electrophotographic photoreceptors 32 to 34 were prepared. Then, by forming above-described uppermost surface layer 2 on the electrophotographic photoreceptors 32 to 34 (base photoreceptors 32 to 34), the electrophotographic photoreceptors of Examples 33 to 35 were prepared. Using the electrophotographic photoreceptors of Examples 33 to 35 obtained, images were formed using an image-forming apparatus of a contact charging system wherein the time from the light exposure to the development was 150 m sec., and the responsive properties were compared. The ratios of the wear rates are shown in Table 8. Also, the evaluations of the images obtained are shown in Table 9.

Examples 36 to 38

By forming uppermost surface layer 2 having the thickness of 3.5 μm, 7 μm, or 10 μm respectively on the electrophotographic photoreceptors (base photoreceptor 34) wherein the thickness of the charge transport layer was 15 μm, the electrophotographic photoreceptors of Examples 36 to 38 were prepared. Using the electrophotographic photoreceptors of Examples 36 to 38 obtained, images were formed as in Examples 33 to 35, and the responsive properties were compared. The ratios of the wear rates are shown in Table 8 and the evaluations of the images obtained are shown in Table 8.

Comparison of responsive properties:

Using the electrophotographic photoreceptors of Examples 33 to 35 and Comparative Examples 32 to 34 having changed thickness of each charge transport layer and the electrophotographic photoreceptors of Examples 36 to 38 having changed uppermost surface layer, responsive properties were compared. The comparative property was evaluated by forming images using an image-forming apparatus of a contact charging system wherein the time from the light exposure to the development was 150 m sec., and comparing the image qualities of the images obtained. The responsive property is better as the image quality is good.

TABLE 8

| | Base photoreceptor | | Uppermost surface layer | | Ratio of base photoreceptor to wear rate | |
|---|---|---|---|---|---|---|
| | | Thickness of charge transport layer | | Thickness | Contact charging system | Non-contact charging system |
| Example 33 | Photoreceptor 18 | 30 μm | Uppermost surface layer 2 | 5 μm | 0.17 | 0.12 |
| Example 34 | Photoreceptor 18 | 25 μm | Uppermost surface layer 2 | 5 μm | 0.17 | 0.12 |
| Example 35 | Photoreceptor 18 | 15 μm | Uppermost surface layer 2 | 5 μm | 0.17 | 0.12 |
| Example 36 | Photoreceptor 18 | 15 μm | Uppermost surface layer 2 | 3.5 μm | 0.17 | 0.12 |
| Example 37 | Photoreceptor 18 | 15 μm | Uppermost surface layer 2 | 7 μm | 0.17 | 0.12 |
| Example 38 | Photoreceptor 18 | 15 μm | Uppermost surface layer 2 | 10 μm | 0.17 | 0.12 |

TABLE 9

| | *1 Contact charging system<br>*2 30 mm<br>*3 150 msec<br>Image quality |
|---|---|
| Example 33 | G- 4 |
| Example 34 | G- 3 |
| Example 35 | G- 1 |
| Example 36 | G- 1 |
| Example 37 | G- 1 |
| Example 38 | G- 2 |

*1: charging system
*2: Diameter of electrophotographic photoreceptor
*3: Time from exposure to development
Unit of wear rate: (nm/1000 rotation of the electrophotographic photoreceptor)

By the examples and the comparative examples, it can be seen that by using the electrophotographic photoreceptor having the high-speed responsive property and the stability by forming a layer having a high charge mobility at the under layer and a layer having the high printing durability as the uppermost surface layer, a small-sized and high-speed electrophotographic image-forming apparatus giving less image flowing is obtained, and particularly, the effects of the case of employing a contact charging system are large.

As described above, the present invention can provide a small-sized and high-speed electrophotographic image-forming apparatus excellent in the printing durability and stability and giving less image flowing.

What is claimed is:

1. An image-forming apparatus of an electrophotographic system comprising an electrophotographic photoreceptor, an electrostatic charger, a light-exposure, a developing device, and a transferring device, wherein said electrophotographic photoreceptor is an electrophotographic photoreceptor having at least a charge generating layer, a charge transport layer, and an uppermost surface layer successively laminated on an electrically conductive substrate, said charge transport layer having a material-containing layer containing at least 45% by weight of a charge transporting material, and wherein a wear rate of said uppermost surface layer is less than a wear rate of said material-containing layer, and a time from a light-exposure to a development is not longer than 150 m sec.

2. The image-forming apparatus according to claim 1 wherein said material-containing layer contains at least 50% by weight the charge transporting material.

3. The image-forming apparatus according to claim 1 wherein said material-containing layer is formed using at least one compound containing a triarylamine structure.

4. The image-forming apparatus according to claim 3 wherein the compound containing a triarylamine structure is a polymer containing the triarylamine structure as a repeating unit.

5. The image-forming apparatus according to claim 1 wherein the charge mobility of said material-containing layer is at least $1\times10^{-5}$ $cm^2/V\cdot sec.$ in an electric field strength of 30 $V/\mu m$.

6. The image-forming apparatus according to claim 1 wherein the uppermost surface layer is formed using at least one kind of a charge transporting compound containing a nitrogen atom in the structure.

7. The image-forming apparatus according to claim 6 wherein the charge transporting compound containing a nitrogen atom in the structure is a compound containing a triarylamine structure.

8. The image-forming apparatus according to claim 1 wherein the uppermost surface layer is formed using at least one kind of a crosslinking compound.

9. The image-forming apparatus according to claim 8 wherein the crosslinking compound is a charge transporting compound containing a nitrogen atom in the structure.

10. The image-forming apparatus according to claim 1 wherein the uppermost surface layer is formed using at least one kind of a compound containing at least a charge transporting component and at least one silicon atom having a hydrolyzing substituent in the same molecule.

11. The image-forming apparatus according to claim 1, wherein a ratio of the wear rate of the uppermost surface layer to the wear rate of said material-containing layer (the wear rate of the uppermost surface layer/the wear rate of said material-containing layer) is 0.5 or less.

12. The image-forming apparatus according to claim 1 wherein the outside diameter of the electrophotographic photoreceptor is not larger than 30 mm.

13. The image-forming apparatus according to claim 1 wherein the time from the light-exposure to the development is not longer than 120 m sec.

14. The image-forming apparatus according to claim 1 wherein the electrostatically charger is a charging device of a contact-charging system.

15. The image-forming apparatus according to claim 14 wherein an applying voltage of the charging device of the contact-charging system contains an alternating electric current component.

* * * * *